US010323445B2

(12) United States Patent
Paskonis

(10) Patent No.: US 10,323,445 B2
(45) Date of Patent: Jun. 18, 2019

(54) VEHICLE LIFTGATE STRIKER AND LATCH CONSTRUCTION

(71) Applicant: AMANDA MANUFACTURING, LLC, Livonia, MI (US)

(72) Inventor: Almantas K. Paskonis, Concord Township, OH (US)

(73) Assignee: Amanda Manufacturing, LLC, Livonia, MI (US)

( * ) Notice: Subject to any disclaimer, the term of this patent is extended or adjusted under 35 U.S.C. 154(b) by 686 days.

(21) Appl. No.: 14/799,718

(22) Filed: Jul. 15, 2015

(65) Prior Publication Data

US 2015/0315825 A1 Nov. 5, 2015
US 2018/0363339 A9 Dec. 20, 2018

Related U.S. Application Data

(63) Continuation of application No. 13/702,772, filed as application No. PCT/US2011/039455 on Jun. 7, 2011, now Pat. No. 9,091,101.
(Continued)

(51) Int. Cl.
*E05B 85/04* (2014.01)
*E05B 17/00* (2006.01)
(Continued)

(52) U.S. Cl.
CPC ..... *E05B 85/04* (2013.01); *E05B 17/0033* (2013.01); *E05B 77/38* (2013.01);
(Continued)

(58) Field of Classification Search
CPC .... E05B 85/045; E05B 77/38; E05B 15/0006; E05B 85/243; E05B 15/022;
(Continued)

(56) References Cited

U.S. PATENT DOCUMENTS 5,069,491 A * 12/1991 Weinerman ..... E05B 77/265 292/216
6,042,160 A 3/2000 Hamada et al.
(Continued)

OTHER PUBLICATIONS

International Search Report re PCT/US2011/039455, dated Oct. 7, 2011, 2 pgs.
(Continued)

*Primary Examiner* — Mark A Williams
(74) *Attorney, Agent, or Firm* — Hahn Loeser & Parks LLP

(57) ABSTRACT

Several vehicle liftgate striker and latch constructions are disclosed. The striker includes a striker base from which at least one striker pin extends. A latch, having a latch cover, is configured to be mounted on a vehicle liftgate, for juxtaposition to the striker base when the liftgate is closed and the latch engages the at least one striker pin. The striker includes a reactor structure for making contact with the latch cover, when the liftgate is closed, for controlling lateral movement of the latch relative to the striker base. The reactor structure preferably includes at least one roller mounted on a roller support, The latch cover has at least one side which Is angled, so as to exert force, having a lateral component, on the reactor structure. The at least one angled side of the latch cover may Include a detent, for providing additional restraining force, when the liftgate is in the closed position.

19 Claims, 21 Drawing Sheets

Related U.S. Application Data

(60) Provisional application No. 61/397,111, filed on Jun. 7, 2010.

(51) Int. Cl.
*E05B 83/16* (2014.01)
*E05B 77/38* (2014.01)
*E05B 85/24* (2014.01)

(52) U.S. Cl.
CPC ..... *E05B 83/16* (2013.01); *E05B 85/045* (2013.01); *E05B 85/24* (2013.01); *Y10T 292/0911* (2015.04)

(58) Field of Classification Search
CPC .... E05B 15/0295; E05B 63/244; E05B 77/36; E05B 81/22; E05B 15/02; E05B 15/0205; E05B 15/0225; Y10T 292/68; Y10T 292/688; Y10T 292/691; Y10T 292/683; Y10T 292/702; Y10T 292/685; Y10T 292/696
USPC ..... 292/340, 195, 341, 341.11–341.13
See application file for complete search history.

(56) References Cited

U.S. PATENT DOCUMENTS 6,155,618 A * 12/2000 Ichinose ..... E05B 85/045 292/216
6,883,842 B2 4/2005 Paskonis
7,097,219 B2 8/2006 Paskonis
7,144,065 B2 12/2006 McClure et al.
8,534,745 B1 * 9/2013 Quinn ..... E05B 77/38 292/340
9,091,101 B2 * 7/2015 Paskonis ..... E05B 17/0033
9,316,021 B2 * 4/2016 Burciaga ..... E05B 15/0295
2002/0000727 A1 * 1/2002 Rass ..... E05B 85/045 292/216
2003/0107222 A1 * 6/2003 Paskonis ..... E05B 77/10 292/340
2004/0104592 A1 * 6/2004 Fisher ..... E05B 15/0006 296/146.1
2007/0114802 A1 5/2007 Johnson et al.
2007/0241570 A1 10/2007 Paskonis
2009/0243311 A1 * 10/2009 Johnson ..... E05B 15/022 292/219
2011/0025079 A1 2/2011 Paskonis
2013/0031843 A1 * 2/2013 Thorpe ..... E05B 77/36 49/503
2013/0031844 A1 * 2/2013 Quinn ..... E05B 77/38 49/503
2013/0249220 A1 * 9/2013 Paskonis ..... E05B 17/0033 292/95

OTHER PUBLICATIONS

International Preliminary Report on Patentability re PCT/US2011/039455, dated Dec. 10, 2012, 1 pg.
Written Opinion re PCT/US2011/039455, dated Oct. 7, 2011, completion date Sep. 28, 2011, 4 pgs.

* cited by examiner

VEHICLE LIFTGATE STRIKER AND LATCH CONSTRUCTION

CROSS REFERENCE TO RELATED APPLICATION

This application is a continuation of U.S. patent application Ser. No. 13/702,772 titled "VEHICLE LIFTGATE STRIKER AND LATCH CONSTRUCTION," filed on Jun. 6, 2013 and issued Jul. 28, 2015 as U.S. Pat. No. 9,091,101 which is a national stage filing of International Patent Application No. PCT/US2011/039455 titled "VEHICLE LIFTGATE STRIKER AND LATCH CONSTRUCTION." filed Jun. 7, 2011, which further claims the benefit of and priority to U.S. Provisional Patent Application No. 61/397,111, titled "VEHICLE LIFTGATE STRIKER AND LATCH CONSTRUCTION," filed Jun. 7, 2010, each of which are hereby incorporated in their entirety.

FIELD OF THE INVENTION

The invention relates to locking mechanisms, particularly for vehicle liftgates, and further in particular to striker and latch structures, as opposed to actual lock mechanisms.

SUMMARY OF THE INVENTION

The present invention is directed to vehicle liftgate striker and latch constructions, used to hold a vehicle liftgate in, and release it from, a closed and locked position.

In particular, the present invention is directed to a vehicle liftgate striker and latch construction which is configured to control lateral movement of the liftgate, relative to the striker, and to provide assistance in pushing the liftgate away from the striker, when the latch is unlocked, by advantageously configuring the latch cover with a tapered profile, in combination with resilient latch reaction assemblies associated with the striker assembly.

BRIEF DESCRIPTION OF THE DRAWINGS

Any indicia shown herein are for illustrative purposes only, and the scope of the invention is not to be construed to be limited thereto. Any numerical values appearing herein are provided solely as examples of an embodiment or embodiments of the invention, and the scope of the invention is not limited by them.

DETAILED DISCLOSURE OF THE INVENTION

Figure 1:
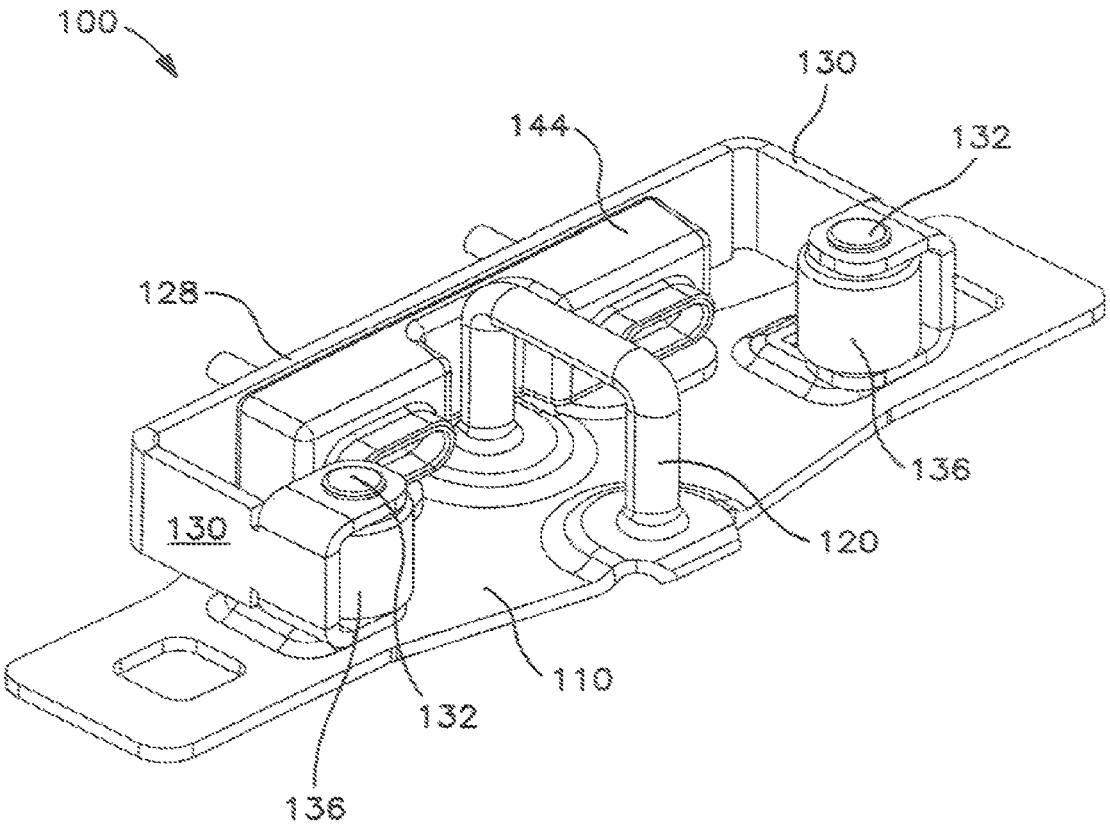
FIG. 1 is a perspective view of the striker assembly according to an embodiment of the invention.
Figure 2:
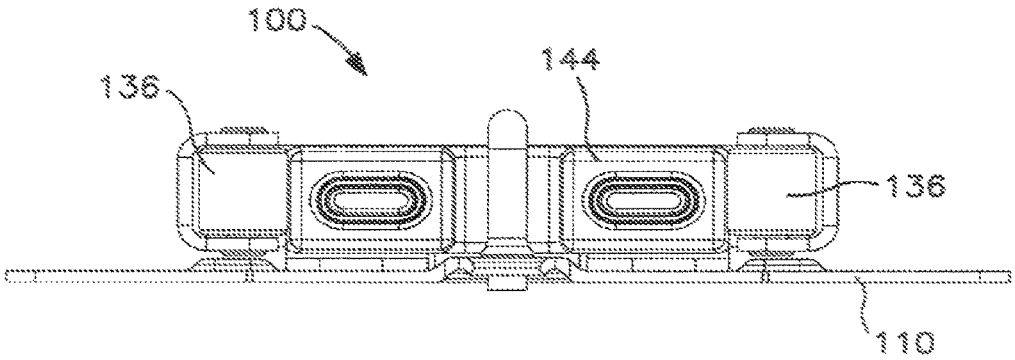
FIG. 2 is a front view of the striker assembly of FIG. 1.
Figure 3:
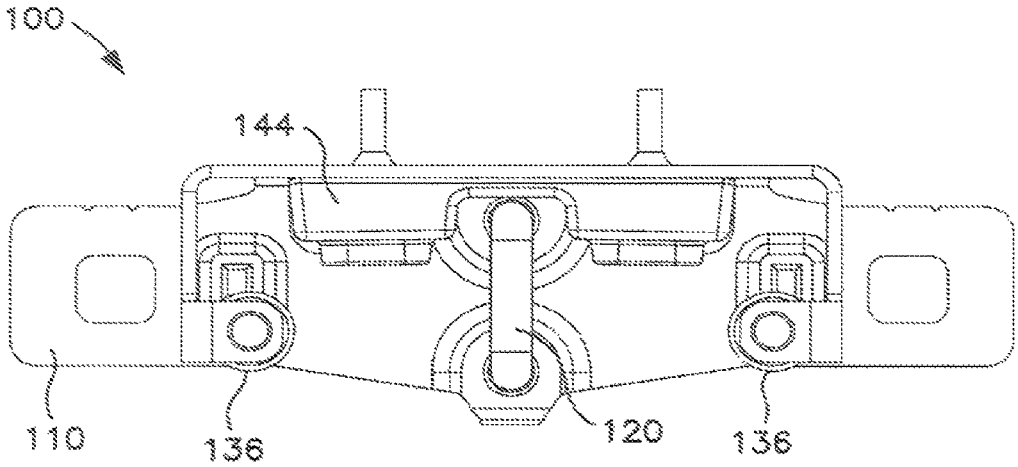
FIG. 3 is a top view of the striker assembly of FIG. 1.
Figure 4:
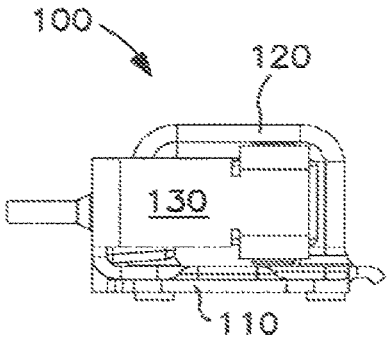
FIG. 4 is an end view of the striker assembly of FIG. 1.
Figure 5:
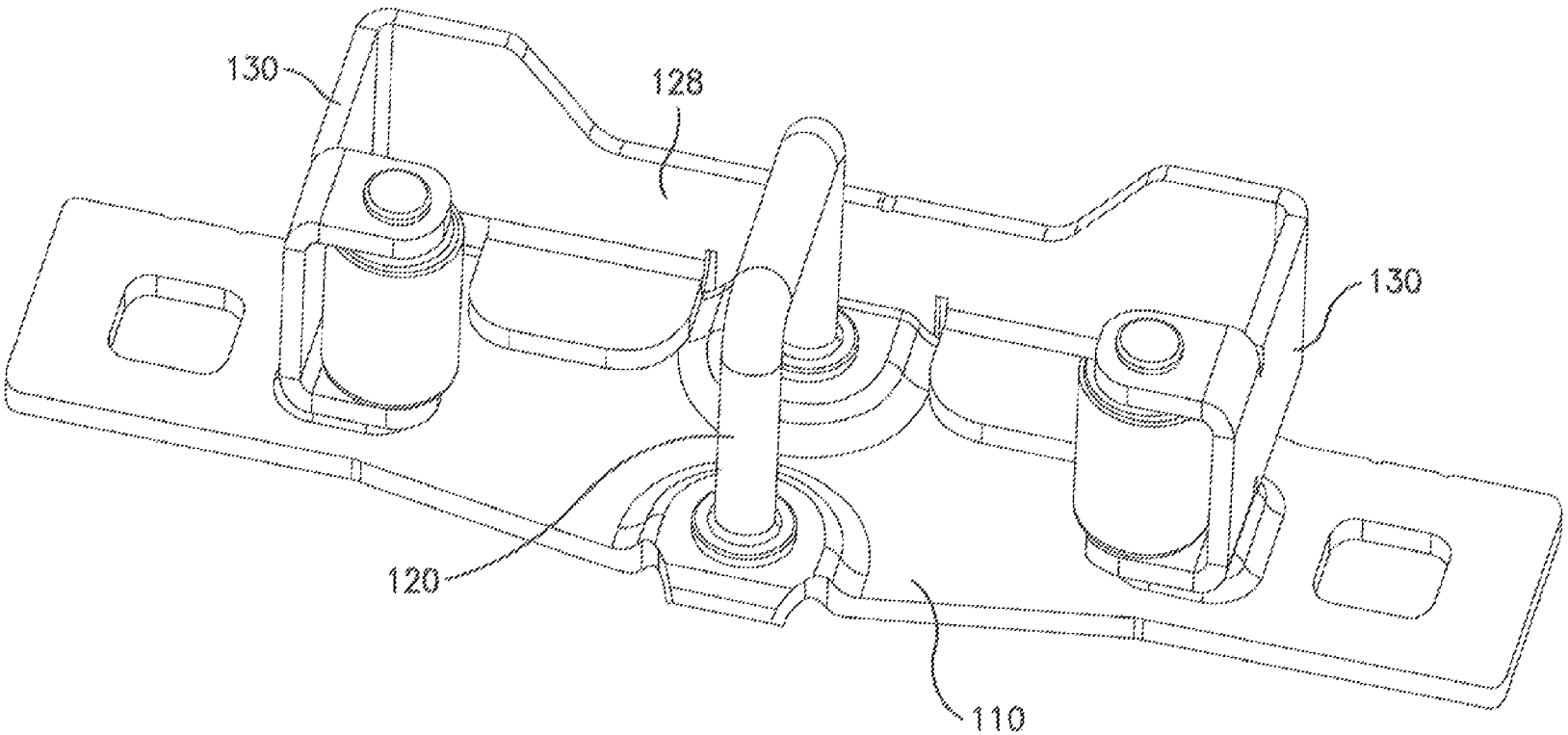
FIG. 5 is a perspective view of the striker assembly of FIG. 1, with the overtravel bumper omitted.
Figure 6:
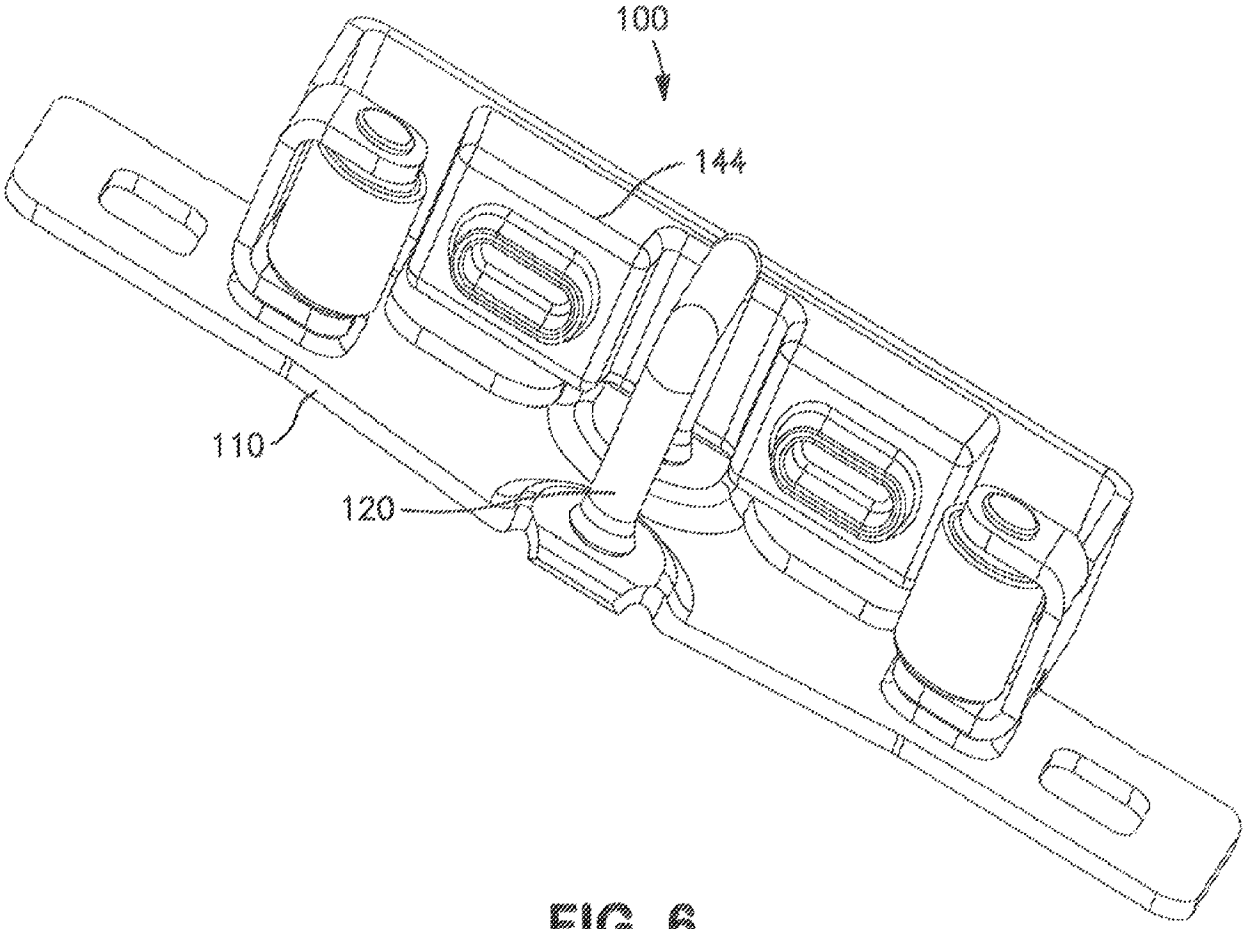
FIG. 6 is a another perspective view of the striker assembly of FIG. 1.
Figure 7:
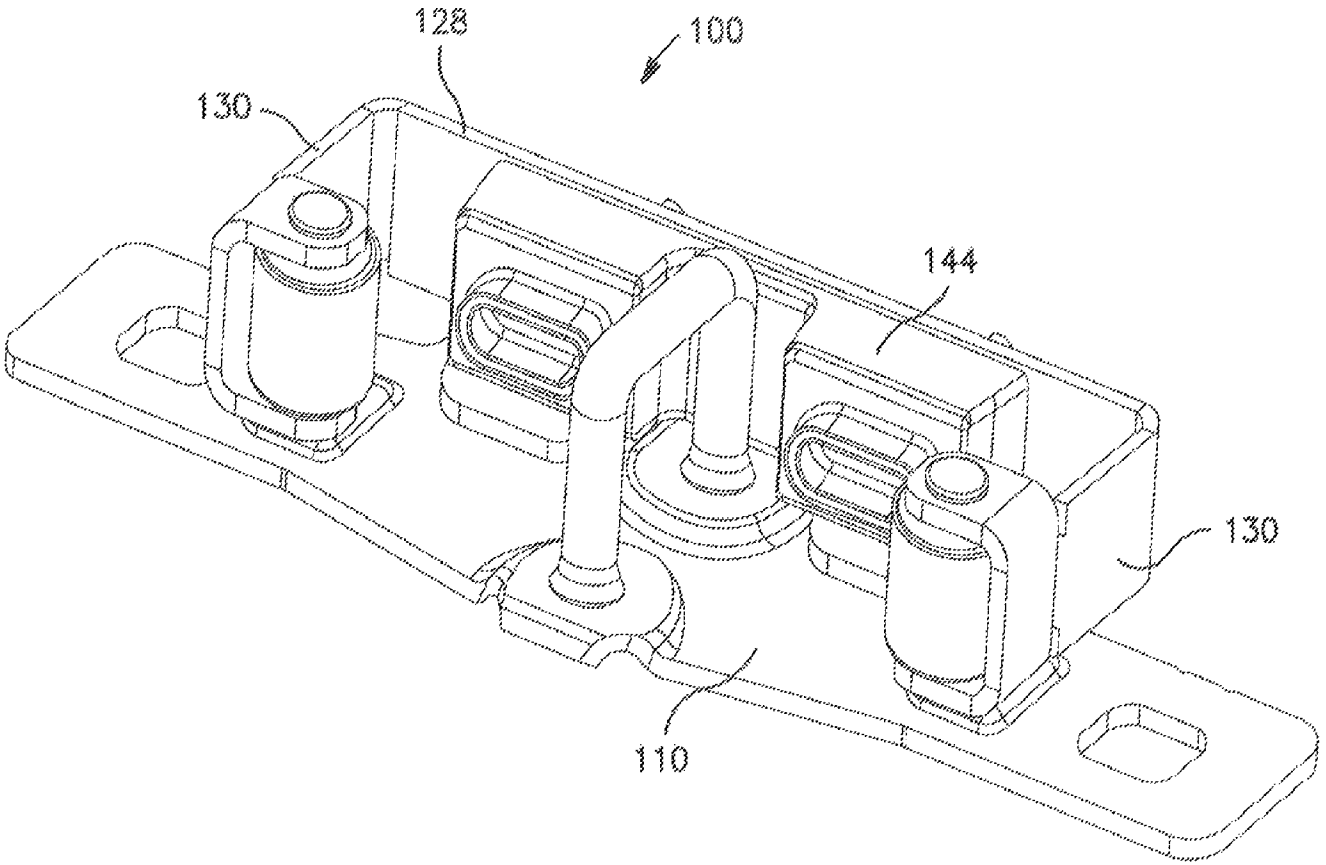
FIG. 7 is still another perspective view thereof.
Figure 8:
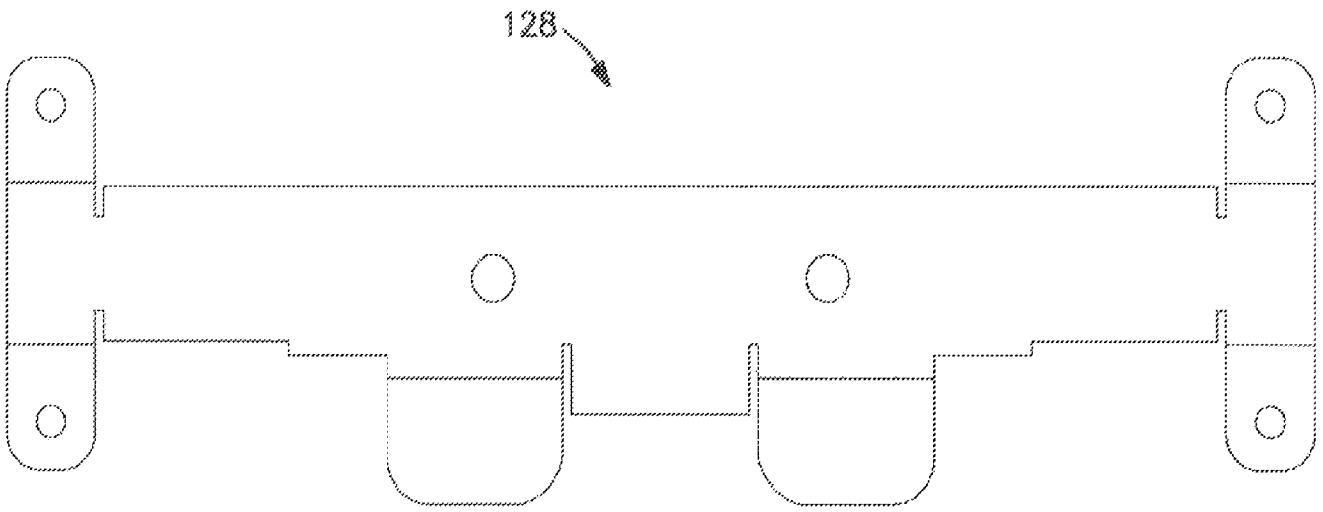
FIG. 8 is a plan view of the striker base, prior to forming.
Figure 9:
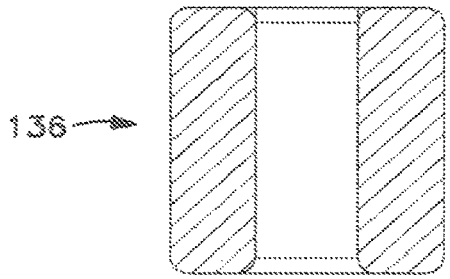
FIG. 9 is a side elevation in section of a roller for the striker assembly.
Figure 11:
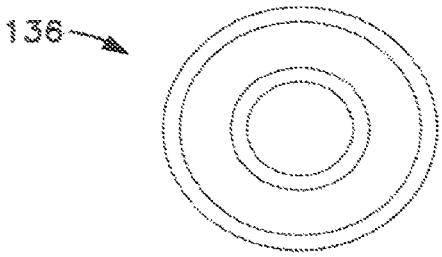
FIG. 11 is a top view thereof.
Figure 10:
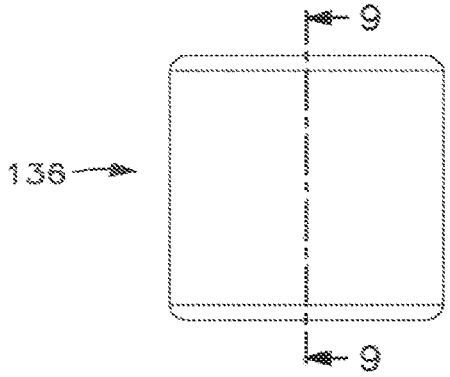
FIG. 10 is a side elevation of the roller of FIG. 9.
Figure 12:
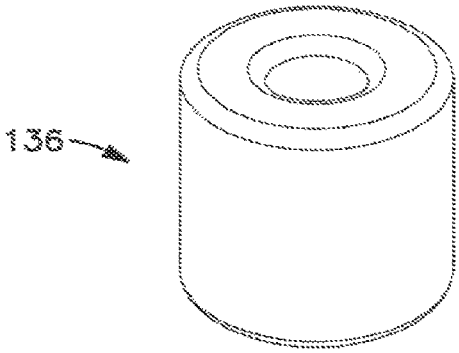
FIG. 12 is a perspective view thereof.
Figure 13:
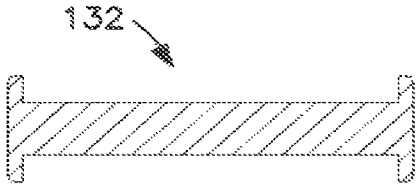
FIG. 13 is a side elevation, in section, of a roller pin for the striker assembly of the present invention.
Figure 14:
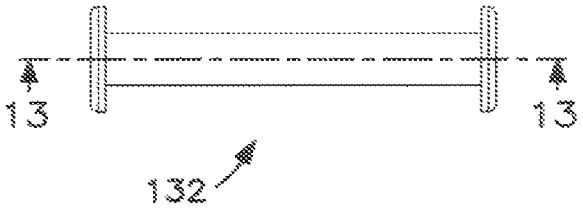
FIG. 14 is a side elevation thereof.
Figure 15:
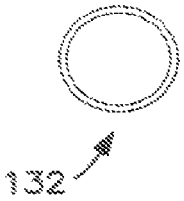
FIG. 15 is an end view thereof.
Figure 16:
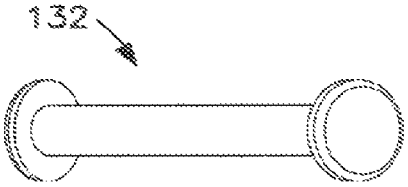
FIG. 16 is a perspective view thereof.
Figure 17:
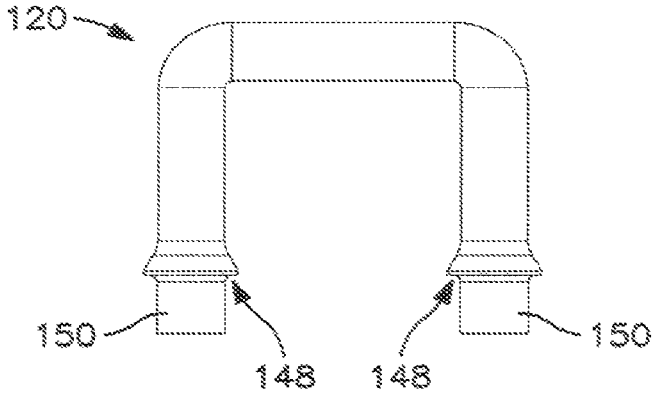
FIG. 17 is a side elevation of the wire form (or striker pin) for the striker assembly according to an embodiment of the invention.
Figure 18:
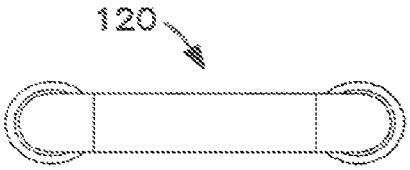
FIG. 18 is a top view thereof.
Figure 19:
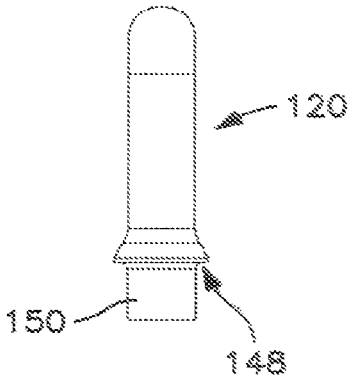
FIG. 19 is an end view thereof.
Figure 20:
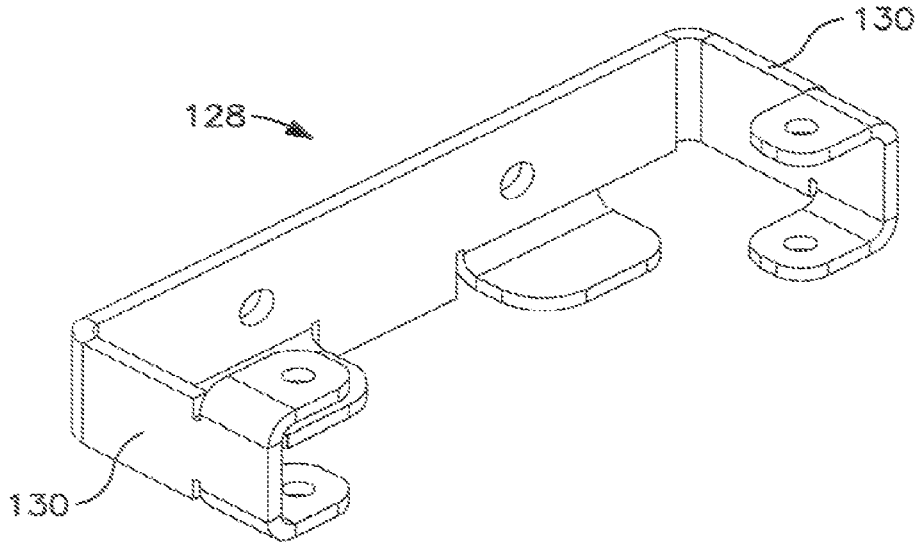
FIG. 20 is a perspective view of the roller support structure for the striker assembly according to an embodiment of the invention.
Figure 21:
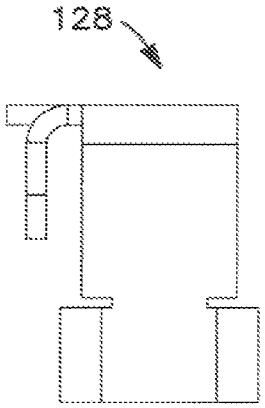
FIG. 21 is an end view thereof.
Figure 22:
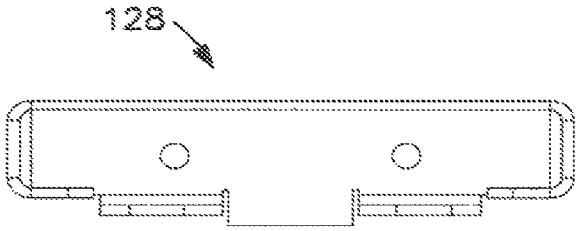
FIG. 22 is a front view thereof.
Figure 23:
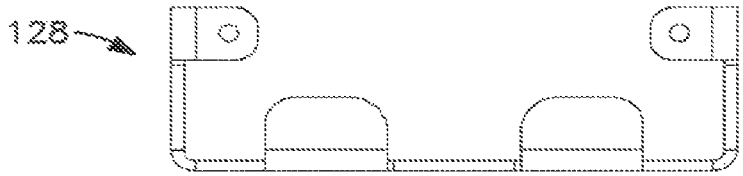
FIG. 23 is a bottom view thereof.
Figure 24:
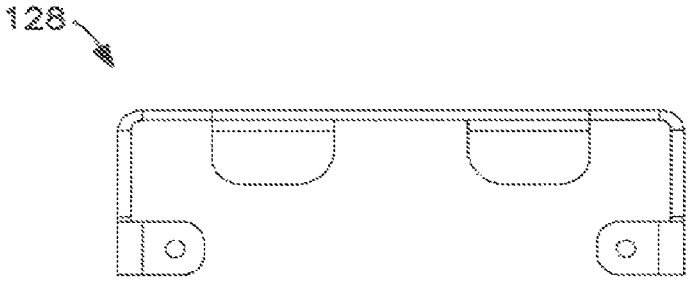
FIG. 24 is a top view thereof.
Figure 25:
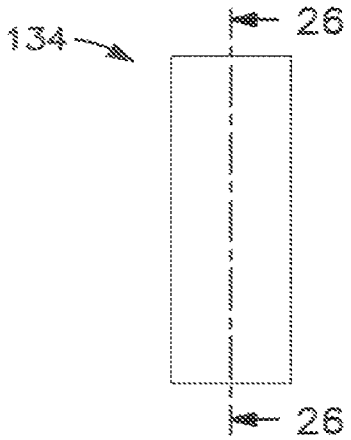
FIG. 25 is a side elevation of a roller sleeve for the striker assembly according to an embodiment of the invention.
Figure 26:
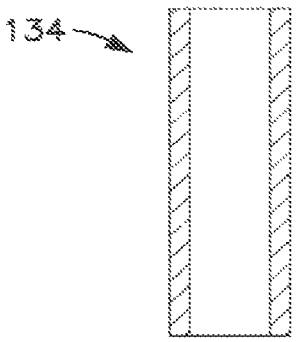
FIG. 26 is a side elevation in section thereof.
Figure 27:
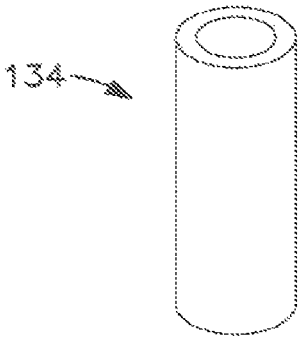
FIG. 27 is a top perspective view thereof.
Figure 28:
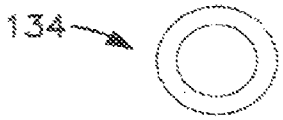
FIG. 28 is an end view thereof.
Figure 29:
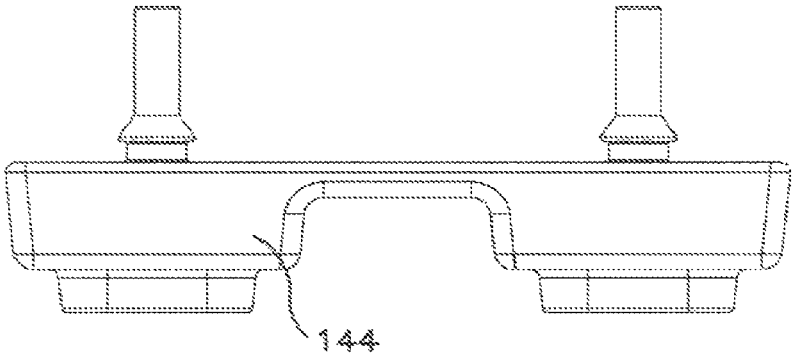
FIG. 29 is a top view of the overtravel bumper for the striker assembly according to an embodiment of the invention.
Figure 30:
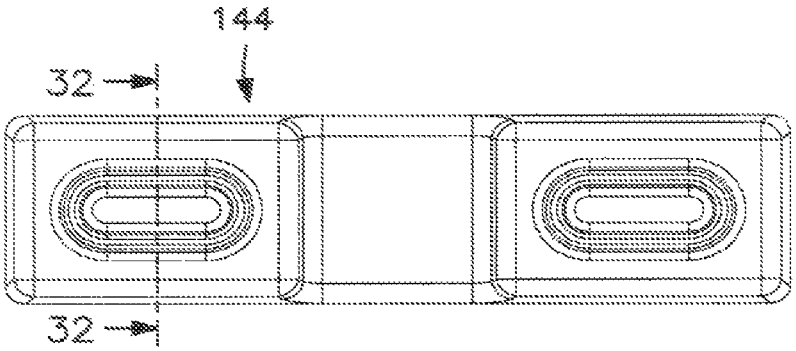
FIG. 30 is a front view thereof.
Figure 31:
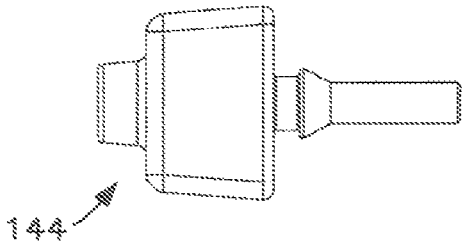
FIG. 31 is an end view thereof.
Figure 32:
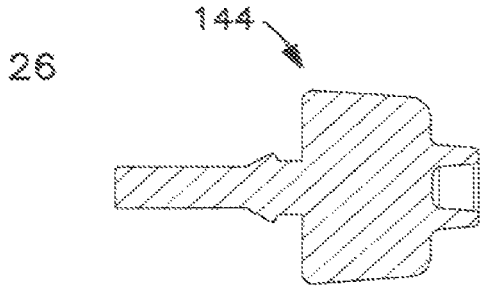
FIG. 32 is a sectional view thereof.
Figure 33:
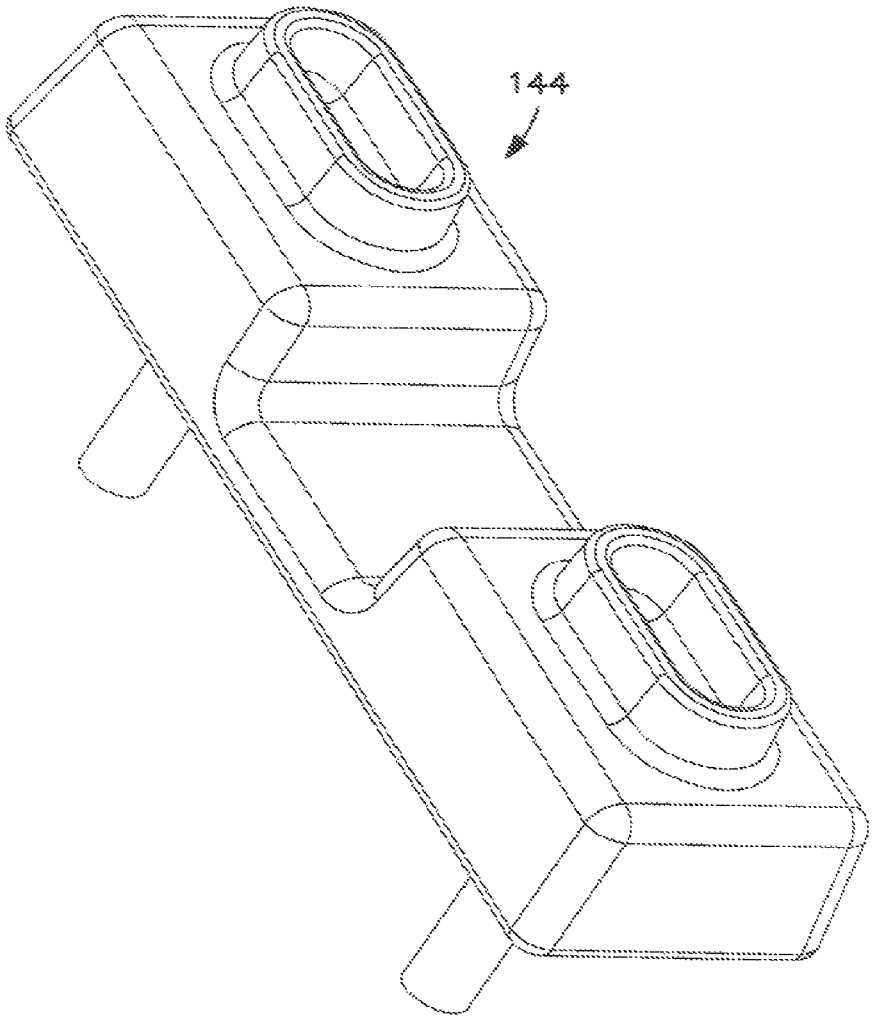
FIG. 33 is a perspective view thereof.

While this invention is susceptible of embodiment in many different forms, there are shown in the drawings and will herein be described in detail, several embodiments with the understanding that the present disclosure should be considered as an exemplification of the principles of the invention and is not intended to limit the invention to the embodiments so illustrated. Further, to the extend that any numerical values or other specifics of materials, etc., are provided herein, they are to be construed as exemplifications of the inventions herein, and the inventions are not to be considered as limited thereby.

Figure 34:
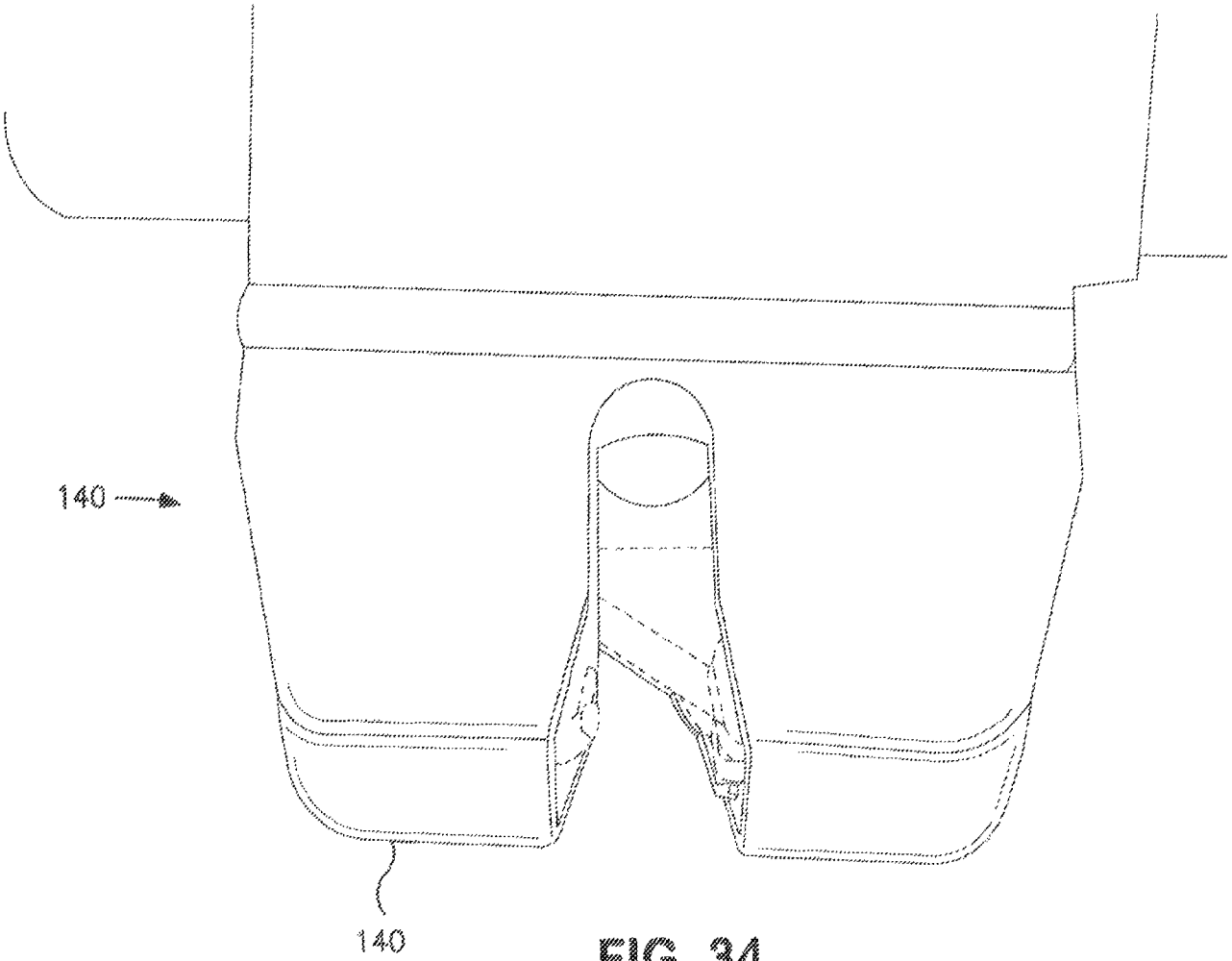
FIG. 34 is a top perspective view of a liftgate latch cover for use with the striker assembly according to an embodiment of the invention.
Figure 35:
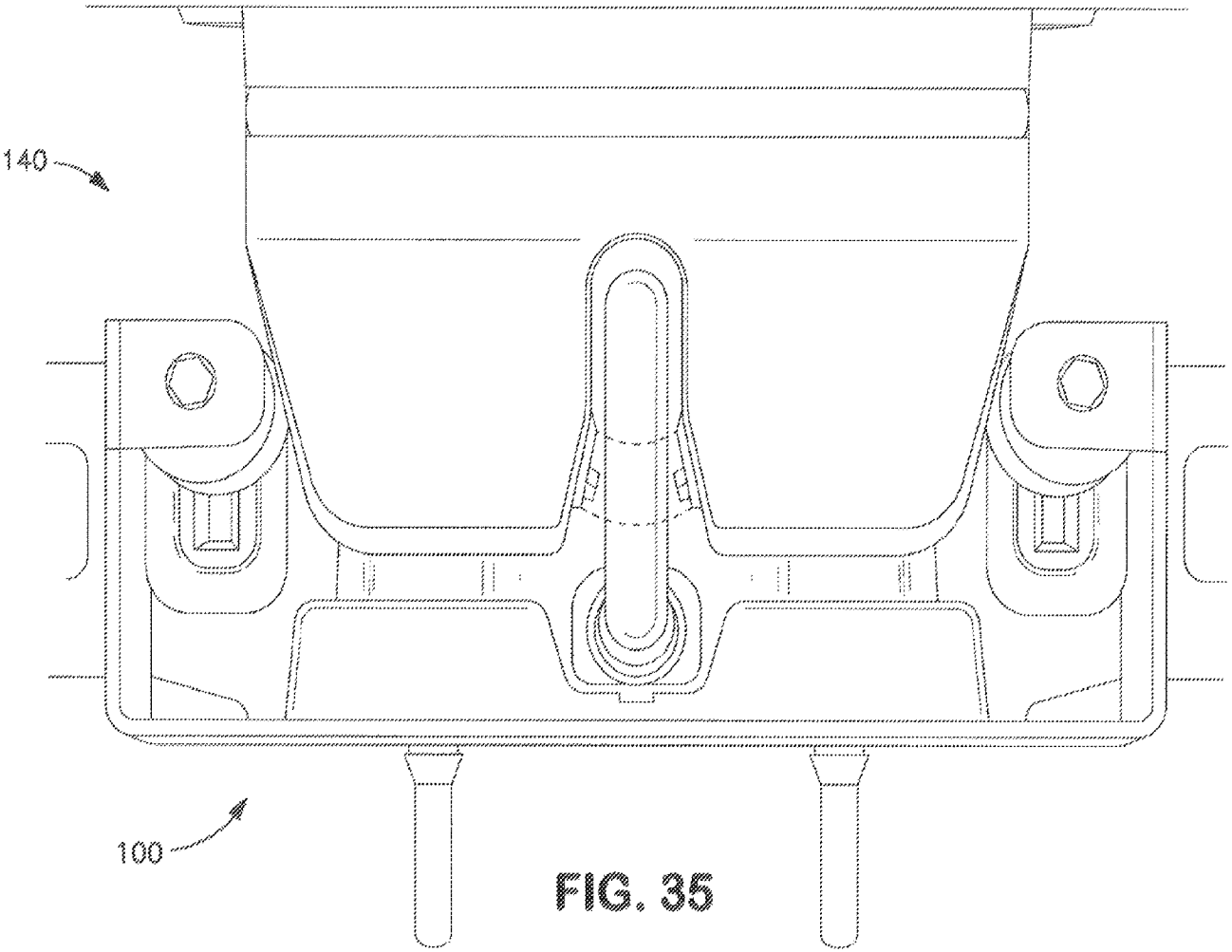
FIG. 35 is a top view of the latch of FIG. 34, shown in engagement with a striker assembly according to an embodiment of the invention.
Figure 36:
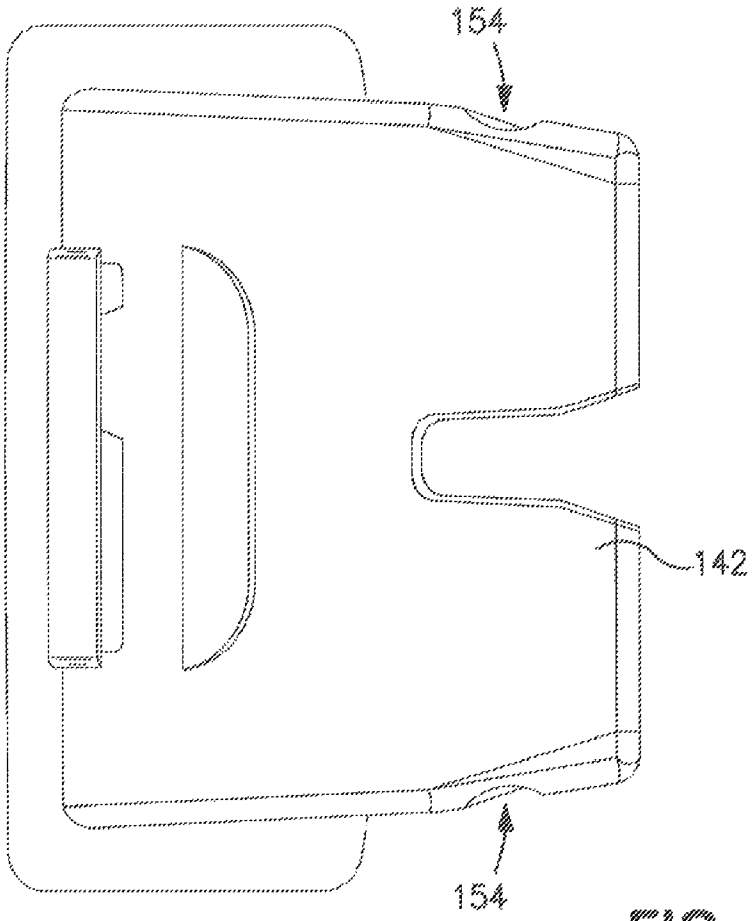
FIG. 36. is a schematic illustration of a latch cover for use with the present invention, showing several alternative configurations.
Figure 37:
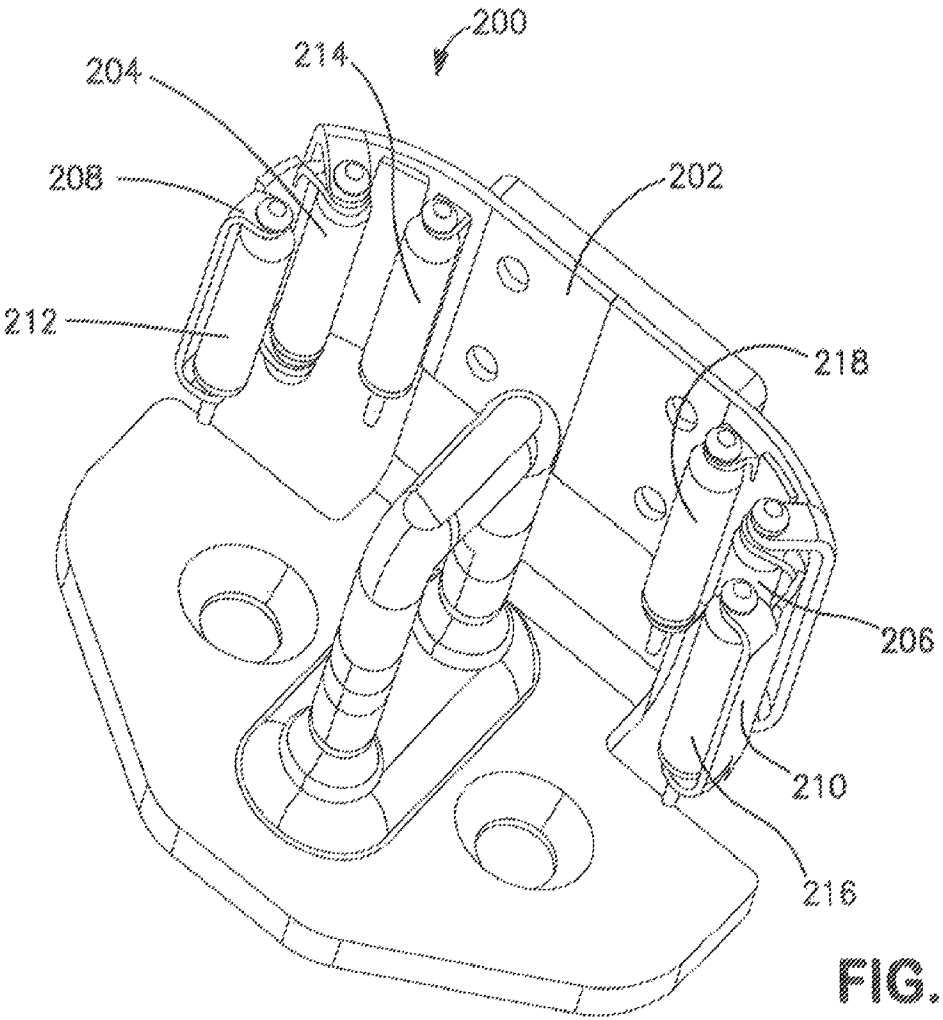
FIG. 37 is a perspective view of a striker configuration according to an alternative embodiment of the invention.
Figure 38:
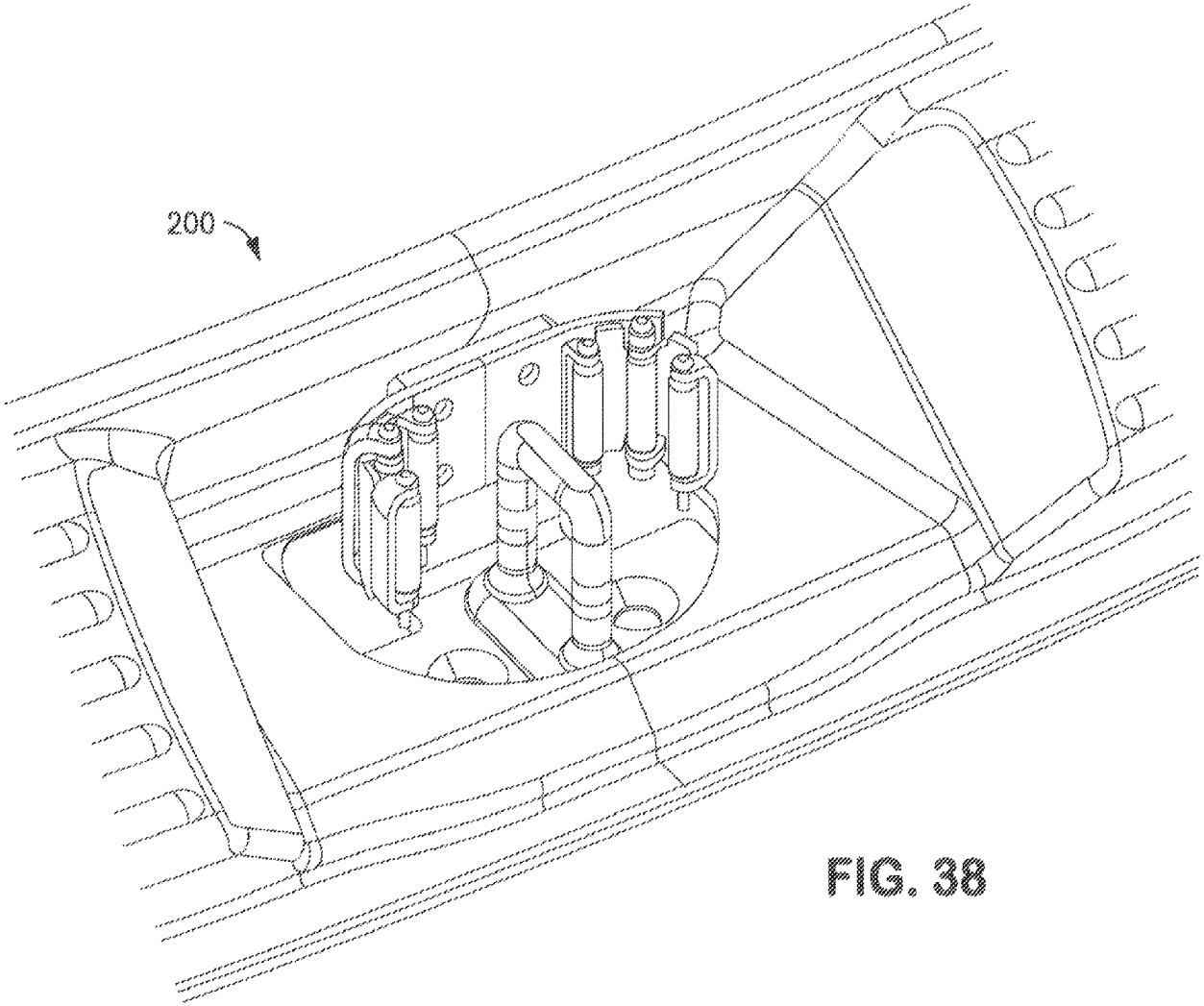
FIG. 38 is a further perspective view thereof.

An embodiment of the vehicle liftgate striker and latch construction of the present invention is shown in FIGS. 1-36. The liftgate striker is intended to reduce door to body vibration and movement. The striker assembly 100 (e.g., FIGS. 1-7) includes base plate 110 and U-shaped wire form 120 as the primary striker features to engage with a latch 140 (FIGS. 34-36) for retention of a vehicle door, hood, deck lid or other closure. It is to be noted that the present invention concerns itself primarily with the interaction between the latch cover 142 and the structures surrounding the striker pin (wire form 120), and not the direct interaction between the latching members and the striker pin (wire form 12) themselves. As such a variety of different latching mechanisms may be employed by one of ordinary skill in the art, without departing from the scope of the present invention. Therefore, the latching mechanism is shown in broken lines in FIGS. 34-35.

The inherent tolerances in a conventional vehicle door/liftgate closure system allow the door to move when closed and the latch is engaged. The internal tolerances of a conventional latch can allow components to move and thus the door which is attached to the latch and or striker is allowed to move and vibrate.

According to the present invention, a tensioned roller assembly provides compression against the latch cover 142 and reduces the free lateral movement of the latch-to-striker interface. The amount of movement is controlled by the amount of tension roller support arms 130 apply to the latch cover 142. The rollers 136 provide minimal friction when engaging with latch 142, because the rollers 136 roll up the sides of the latch cover 142. The over-travel bumper 144 extending transversely across the end of striker frame 128 is provided to limit the amount of movement transverse to the latch 140 whereas the rollers 136 limit the amount of orthogonal or side to side movement. The roller support arms 130 may be a sub-assembly of the overall assembly 100, or a single part formed from the striker base plate 110.

The rollers 136 engage with the latch cover plate 142. The sides of latch cover plate 142 extend at angles, relative to the plane of the wire form 120, to provide modified closing and opening forces. Latch cover 142 may be provided with one or more detents 154 (FIG. 36) located at the full closed (engaged) position to provide an at-rest or neutral area which would require a higher force to move away from and thus provide a limiting action of movement in the transverse direction (the direction of opening and closing of the liftgate). In particular, by coordinating the included angle between the lateral sides of the latch cover 142 with the amount of spring force applied by the roller support arms 130 holding the rollers 136, upon operator release of the latch 140, the roller support arms 130 holding the rollers 136 "squeeze" the latch cover 142, tending to push the latch cover 142 (and hence the liftgate) up and away from the striker assembly 100, thus enabling a lesser strength spring assembly (the springs or torsion arms used to pivotably support the liftgate—not shown) to be used to support for the door.

Striker assembly 100 comprises two resilient spring roller support arms 130 to which the polymer or rubber (or other suitable material) rollers 136 are attached. Striker assembly 100 further includes U-shaped wire-form (striker pin) 120 which engages the latch 140. The elastomer over-travel bumper 144 is provided to protect the latch from damage from excessive door closing forces. In an embodiment of the invention, wire form 120 is formed with preformed faces 148 which engage the front side of the striker base plate 110 (the side that faces the latch). After positioning of the wire-form 120 on base plate 110, the ends 150 of wire-form 120 may be swaged, to create flattened "buttons" to capture base plate 110 between the buttons and the preformed faces. Other modes of attachment, including welding or brazing, may be employed instead of, or in addition to, swaging, without departing from the scope of the invention.

FIGS. 37-40 illustrate a vehicle liftgate striker configuration according to an alternative embodiment of the invention. Striker assembly 200 includes primary roller support spring plate 202, upon which rollers 204 and 206 are pivotably mounted. Secondary roller support spring arms 208, 210, are mounted on the pins which support rollers 204, 206, respectively. Rollers 212, 214 are pivotably mounted on secondary roller support spring arm 208, and rollers 216, 218 are pivotably mounted on secondary roller support spring arm 210. Striker assembly 200 is configured to accommodate known latch housing 220, which is known from the 2010 Ford Flex and 2010 Ford Expedition, among other vehicles, for example. By providing a plurality of rollers on each "side" of the liftgate latch housing, it is believed that a higher static loading will be placed on the liftgate, as compared to prior art liftgate striker assemblies, while at the same time reducing the dynamic loading that is encountered or perceived by a user, while in the process of closing the liftgate. Detents are not provided in the existing vehicle liftgate latch covers just mentioned.

Figure 39:
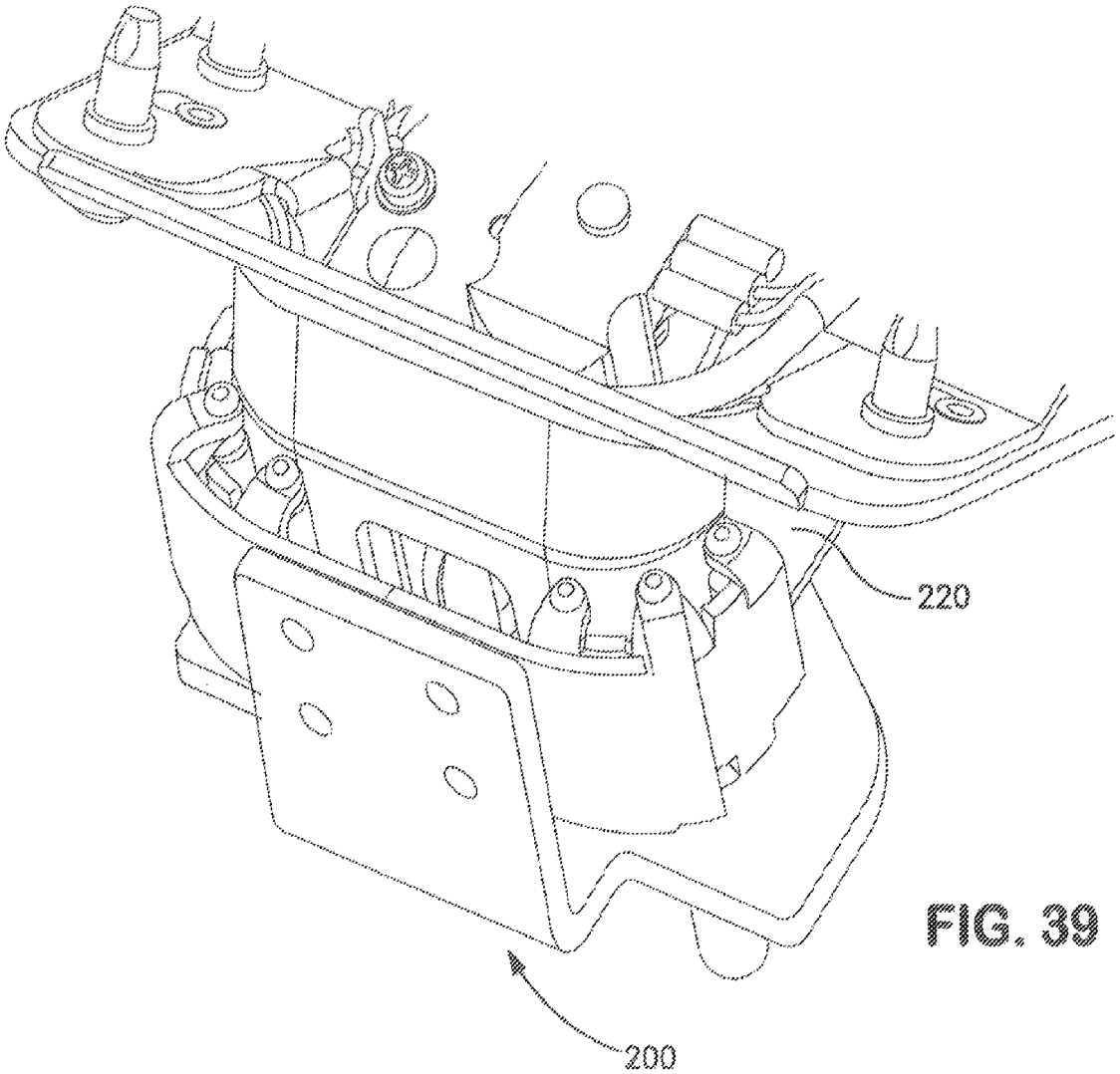
FIG. 39 is a reverse perspective view thereof, showing the interaction between the striker configuration of FIG. 37 and a vehicle liftgate latch.
Figure 40:
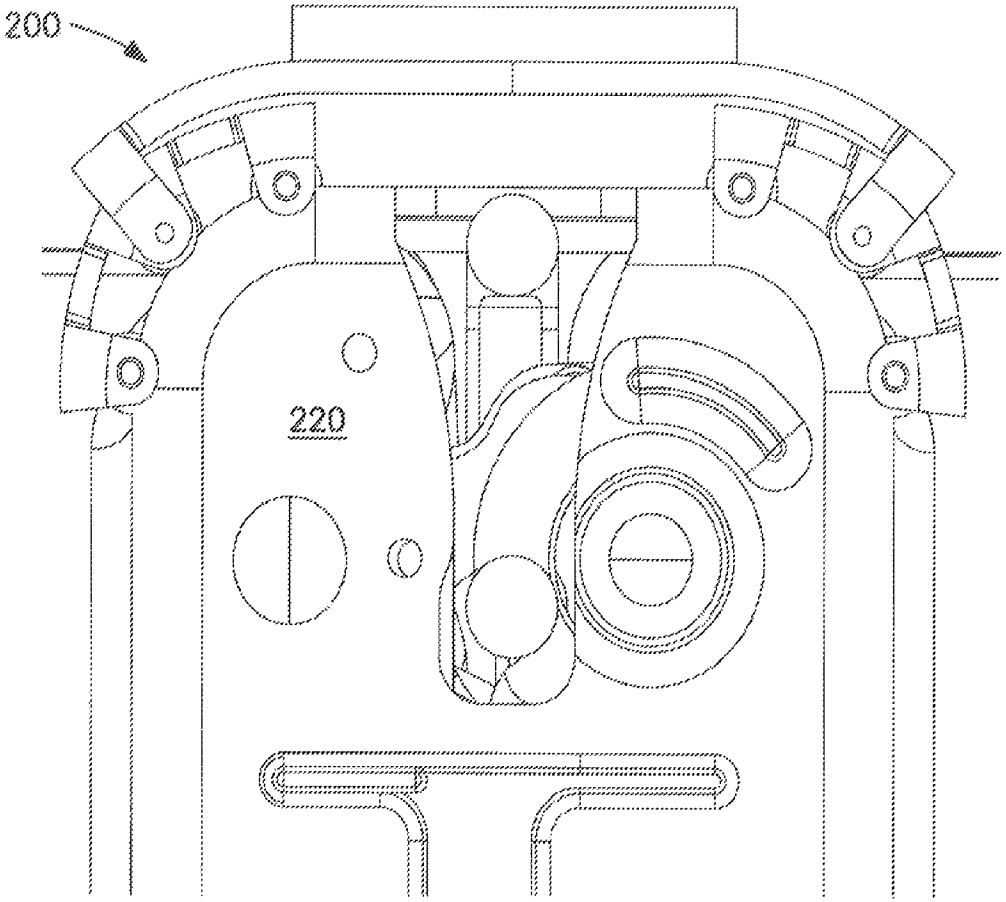
FIG. 40 is a top view of the striker configuration of FIG. 37, in cooperation with a vehicle liftgate latch.

It is further to be understood that while latching structure details may be shown in FIGS. 39 and 40, in association with an alternative embodiment of the invention, it is again the interaction between the striker assembly 200 as a whole, and the latch housing 220, to which the present invention is primarily focused, and not on the particular details of the latch mechanism itself, and other latching mechanisms other than those shown may be used without departing from the scope of the invention.

The foregoing description and drawings merely explain and illustrate the invention, and the invention is not limited thereto, except as those skilled in the art who have the present disclosure before them will be able to make modifications and variations therein without departing from the scope of the invention.

The invention claimed is:

1. A striker assembly, comprising:

a striker base configured to be mounted to a vehicle opening, the striker base having two opposing ends;

at least one striker pin mounted centrally on the striker base between the two opposing ends;

two resilient spring support arms each extending proximate from a respective one of the two opposing ends of the striker base, each of the two resilient spring support arms having a roller pivotally mounted at a free end thereof; and each of the two resilient spring support arms provide a spring force in the direction of the striker pin, such that when a latch is disengaged from the striker pin the spring forces cause the two resilient support arms to squeeze a latch cover via the rollers to provide assistance in pushing the latch away from the striker base.

2. The striker assembly, according to claim 1, wherein the two resilient spring support arms are formed from the striker base.

3. The striker assembly, according to claim 1, further comprising at least one bumper disposed on the striker base and extending across the striker base independent of the two resilient spring support arms.

4. The striker assembly according to claim 3, wherein a void is formed within the at least one bumper and the at least one striker pin is positioned in the void.

5. The striker assembly according to claim 1, further comprising:

a first support arm of the two resilient spring support arms mounted at or proximate one end of the striker base and at least one roller pivotably mounted on the first support arm; and a second support arm of the two resilient spring support arms mounted at or proximate an opposite end of the striker base and a second roller pivotably mounted on the second support arm.

6. The striker assembly according to claim 5, wherein the at least one striker pin mounted on the striker base is positioned between the first support arm and the second support arm.

7. The striker assembly according to claim 6, further comprising at least one bumper disposed on the striker base, wherein the bumper has a symmetrical configuration relative to the at least one striker pin with projecting bumper portions disposed to either side of the at least one striker pin.

8. The striker assembly according to claim 5, wherein the at least one bumper is disposed on the striker base between the first support arm and the second support arm.

9. The striker assembly according to claim 5, wherein a spring force of the first support arm opposes a spring force of the second support arm.

10. The striker assembly according to claim 1, wherein each support arm of the two resilient spring support arms move in a lateral direction away from the at least one striker pin when engaged with the latch cover.

11. The striker assembly according to claim 1, further comprising at least one roller pivotably mounted on each support arm of the two resilient spring support arms where the at least one roller mounted on each support arm roll up a side of the latch cover when engaging the latch cover.

12. The striker assembly according to claim 1, further comprising a primary roller support spring plate attached to the striker base wherein each support arm of the two resilient spring support arms is attached to the primary roller support spring plate.

13. The striker assembly according to claim 12, further comprising one or more secondary roller support spring arms attached to the primary roller support spring arms; and at least one roller pivotably mounted on the one or more secondary roller support spring arms.

14. A striker assembly, comprising:

a striker base configured to be mounted to a vehicle opening, the striker base having two opposing ends;

at least one striker pin mounted centrally on the striker base between the two opposing ends;

two resilient spring roller support arms each extending proximate from a respective one of the two opposing ends of the striker base, each of the two resilient spring support arms having at least one roller at a free end thereof; and each of the two resilient spring support arms provide a spring force in the direction of the striker pin, such that when a latch is disengaging from the striker pin, the spring forces cause the at least one roller of each of the resilient spring support arms to squeeze a latch cover to provide assistance in pushing the latch cover away from the striker base.

15. The striker assembly, according to claim 14, wherein the two resilient spring roller support arms are formed from the striker base.

16. The striker assembly, according to claim 14, further comprising at least one bumper disposed on the striker base and extending across the striker base independent of the two resilient spring roller support arms.

17. The striker assembly according to claim 16, wherein a void is formed within the at least one bumper and the at least one striker pin is positioned in the void.

18. The striker assembly according to claim 14, wherein a first support arm of the two resilient spring roller support arms is mounted at or proximate one end of the striker base and at least one roller is pivotably mounted on the first support arm; and a second support arm of the two resilient spring roller support arms is mounted at or proximate an opposite end of the striker base and at least one roller is pivotably mounted on the second support arm.

19. The striker assembly according to claim 18, further comprising at least one bumper disposed on the striker base and extending across the striker base between the first support arm and the second support arm.

* * * * *